US006081678A

United States Patent [19]

Kato

[11] Patent Number: 6,081,678

[45] Date of Patent: Jun. 27, 2000

[54] IMAGE FORMING APPARATUS AND METHOD TO DETECT AMOUNT OF TONER ADHERED TO A TONER IMAGE

[75] Inventor: Shinji Kato, Kawasaki, Japan

[73] Assignee: Ricoh Company, Ltd., Tokyo, Japan

[21] Appl. No.: 09/234,320

[22] Filed: Jan. 21, 1999

[30] Foreign Application Priority Data

Feb. 4, 1998 [JP] Japan ..... 10-023361

[51] Int. Cl.[7] ..... G03G 15/00

[52] U.S. Cl. ..... 399/49; 399/72

[58] Field of Search ..... 399/49, 38, 46, 399/72, 74, 302, 308; 118/691

[56] References Cited

U.S. PATENT DOCUMENTS

| | | | |
|---|---|---|---|
| 5,625,857 | 4/1997 | Shimada et al. | 399/49 |
| 5,758,235 | 5/1998 | Kosuge et al. | 399/227 |
| 5,765,059 | 6/1998 | Kosuge et al. | 399/224 |
| 5,768,664 | 6/1998 | Kosuge et al. | 399/227 |
| 5,822,079 | 10/1998 | Okuno et al. | 399/46 X |

FOREIGN PATENT DOCUMENTS

| | | |
|---|---|---|
| 7-85184 | 9/1995 | Japan . |

*Primary Examiner*—Arthur T. Grimley
*Assistant Examiner*—Hoan Tran
*Attorney, Agent, or Firm*—Oblon, Spivak, McClelland, Maier & Neustadt, P.C.

[57] ABSTRACT

An image forming apparatus includes an image carrying device for forming and carrying a toner image thereupon. An image reading device optically reads an image to obtain image data of the image for output. An image processing device converts the image data, which is output by the image reading device, into printing image data. An image writing device writes a latent image on the image carrier according to the printing data. A developing device develops the latent image on the image carrier with toner to form a toner image. An image outputting device transfers the toner image, which is developed by the developing device on the image carrying device, to a transfer member and outputs the transfer member carrying the toner image. An internal pattern generating device generates a predetermined image pattern. A toner-amount measuring device measures the amount of toner adhered to a toner image of the predetermined image pattern that is formed on the image carrying device. A control device corrects a table to convert an output of the toner-amount measuring device into an amount of toner according to image density data of the toner image of the predetermined image pattern that is output by the image outputting device, the image density data being converted from image data obtained by reading, with the image reading device, the toner image of the internally generated predetermined image pattern that is output by the image outputting device.

13 Claims, 12 Drawing Sheets

Figure 13 (a)

| Vsg - Vsp (black) | Amount of adhered toner ($mg/cm^2$) |
|---|---|
| 0 | 0 |
| ⋮ | ⋮ |
| 0.950 | 0.2 |
| ⋮ | ⋮ |
| 1.900 | 1.0 |

Figure 13 (b)

| Vsg - Vsp (color) | Amount of adhered toner ($mg/cm^2$) |
|---|---|
| 0 | 0 |
| ⋮ | ⋮ |
| 0.900 | 0.4 |
| ⋮ | ⋮ |
| 1.800 | 1.0 |

| Vsg - Vsp (color) | Amount of adhered toner ($mg/cm^2$) |
|---|---|
| 0 | 0 |
| ⋮ | ⋮ |
| 0.900 | 0.379 |
| ⋮ | ⋮ |
| 1.800 | 0.947 |

IMAGE FORMING APPARATUS AND METHOD TO DETECT AMOUNT OF TONER ADHERED TO A TONER IMAGE

BACKGROUND OF THE INVENTION

1. Filed of the Invention

The present invention relates to an electrophotographic image forming apparatus such as a photocopier, a facsimile machine, a printer, etc., and more particularly to an image forming apparatus having an improved method of detecting the amount of toner adhered to a toner image on an image carrier in a precise manner for controlling a toner supply operation to obtain a desired image quality.

2. Discussion of the Background

An image forming apparatus using an electrophotographic image-forming process is known to perform at least the following process steps: forming an electrostatic latent image on an image carrier by an image-writing device; developing the electrostatic latent image with toner by a developing device; transferring the toner image onto a transfer member such as a transfer paper, directly or via an intermediate transfer member; and fixing the toner image on the transfer paper and outputting the transfer paper carrying the toner image as a final print.

In addition, when the image forming apparatus uses a two-component developer, various process controls, for example, a toner supplying control, a surface voltage control, and the like, are performed in order to obtain a desired image quality. It is known that the quantity (or density) of toner adhered to a toner image on an image carrier, such as a photoconductive member or an intermediate transfer member, is measured for controlling an operation of supplying toner to a developing device from a toner container to obtain a desired image quality.

FIG. 1 illustrates a typical example of a background method of measuring the quantity of toner on a photoconductive drum using a mirror-reflection sensor. The amount of toner on a toner patch 20 that is formed by toner on the photoconductive drum 200 is measured by a sensor 205. The sensor 205 includes a light-emitting device 10 and a light-receiving device 12. The light-emitting device 10 and the light-receiving device 12 are arranged such that infrared light, which is emitted by the light-emitting device 10 and which impinges upon the surface of the photoconductive drum 200 at a certain incident angle relative to the surface of the photoconductive drum 200, is reflected by the photoconductive drum 200 at the same angle as the incident angle, and is then received by the light-receiving device 12. The toner patch 20 has a shape, for example, as shown in FIG. 2. The intensity of the infrared light, which is reflected by the toner patch 20 and received by the light-receiving device 12, changes according to the quantity of toner on the toner patch 20, and thereby the output of the sensor 205 changes.

FIG. 3 illustrates an example of the output characteristics of the sensor 205 shown in FIG. 1. The intensity of light reflected by the toner patch 20 on the photoconductive drum 200 decreases as the amount of toner on the toner patch 20 increases up to a certain amount of toner, such that the output voltage of the sensor 205 decreases, and thereby the amount of toner on the toner patch 20 can be measured based upon the output voltage of the sensor 205. Specifically, as shown in FIG. 3, the output voltage for an amount of black toner on the photoconductive drum 200 decreases in inverse proportion to the amount of toner up to the amount "b", and is then saturated. Thus, the amount of the black toner can be measured only up to the amount "b". However, it may be desirable to measure the amount of the black toner up to the amount "c" which may be, for example, 1 mg/cm$^2$. The reason why the output voltage for the black toner decreases as the amount of the black toner increases is that the reflection coefficient of the black toner is smaller than that of the photoconductive drum surface.

The output voltage for color toner on the photoconductive drum 200 has the characteristic that the output voltage decreases in inverse proportion to the amount of toner up to the amount "a", but less abruptly than the black toner, and then increases, as shown in FIG. 3. Thus, the amount of the color toner can be measured only up to the amount "a". However, it may be desirable to measure the amount of the color toner up to the amount "c". The reason why the output characteristic is changed is that the reflection coefficient of the color toner is smaller than that of the photoconductive drum surface, but is larger than that of the black toner when the amount of the color toner is small, and the reflection coefficient of the color toner becomes larger due to light scattering when the amount of the color toner is large.

FIG. 4 illustrates an example of another method of measuring the quantity of toner on a photoconductive drum with an irregular-reflection sensor. A sensor 205 includes a pair of a light-emitting device 10 and a light-receiving device 11. The light-emitting device 10 and the light-receiving device 11 are arranged such that the light-receiving device 11 receives light, which is emitted by the light-emitting device 10, incident on the surface of the photoconductive drum 200 at a certain incident angle and reflected by the photoconductive drum 200 at an angle differing from the incident angle. The amount of toner is measured in substantially the same manner as in the method using a mirror-reflection sensor.

FIG. 5 illustrates an example of the sensor output characteristics of the irregular-reflection sensor 205 shown in FIG. 4. Generally, color toner has a higher reflection coefficient than the photoconductive drum surface for an irregular-reflection light, and black toner has a lower reflection coefficient than the photoconductive drum surface. Consequently, when the amount of color toner on the photoconductive drum 200 increases, the output voltage of the sensor 205 increases, and when the amount of black toner on the photoconductive drum 200 increases, the output voltage of the sensor 205 decreases. That is, the irregular-reflection sensor 205 can measure the amount of both black and color toner up to desirable amounts of the black and color toner, such as, for example, 1 mg/cm$^2$ respectively.

For precisely measuring the amount of toner on the photoconductive member surface by a sensor, it is desirable that the output characteristics of the sensor are always kept as shown in FIG. 5. However, various factors affect and change the output characteristics of the sensor 205 in actuality, which hampers precisely measuring the amount of toner on the photoconductive member.

For example, when scattered toner stains the sensor 205, the optical characteristics of the light-emitting device 10 and the light-receiving device 11 are affected, and the initial characteristics of the sensor 205 indicated by the solid line in FIG. 5 are changed, for example, to the characteristics indicated by the broken line in FIG. 6. The solid line in FIG. 6, which is the same as the solid line in FIG. 5, is reprinted for reference to the broken line.

Further, even when the sensor 205 is not stained by toner or deteriorated to cause a change in the optical characteristics, some parts which physically contact the photoconductive drum 200, such as a cleaning blade or a cleaning brush of a cleaning device, a transfer roller or a transfer belt, or an intermediate transfer belt of a transfer device, a developer-mix of a developing device, may damage a surface of the photoconductive drum 200. FIG. 7 illustrates an example of the sensor output characteristics of the irregular-reflection sensor 205 when the surface of the photoconductive drum 200 is damaged (indicated by the broken line) and when the surface of the photoconductive drum 200 is not damaged (indicated by the solid line). The damaged surface of the photoconductive drum 200 increases irregular-reflection. Therefore, the output characteristics of the sensor 205 are most effected when no toner is put on the surface, and as the amount of toner increases the influence of the damaged surface of the photoconductive drum 200 decreases, because the damaged surface of the photoconductive drum 200 is covered by the increased amount of toner.

Such a change in the output characteristics of the sensor 205 can be compensated, for example, by installing a standard reflecting member for reference and adjusting the output of the sensor 205 when the amount of toner on the photoconductive drum surface is measured by the sensor 205. However, installment of an additional component, such as the reflecting member, not only increases costs but also creates another problem that the additional reflecting member itself may be stained by toner.

Japanese Patent Publication No. 85184/1995 describes a sensor which has two light-receiving devices 11 and 12 as shown in FIG. 8, one for receiving a mirror-reflection light and the other for receiving an irregular-reflection light. The above JP No. 85184/1995 describes that the devices 11 and 12 are adjusted such that the difference of the two output signals of the devices 11 and 12 relative to a predetermined toner patch becomes a predetermined value, for accomplishing a stable measurement of the amount of toner adhered to a toner image on the photoconductive drum 200 even when the devices 11 and 12 are stained. The sensor 205, however, cannot be adjusted in response to a change in the reflection caused by damage on the surface of the photoconductive drum 200.

When the irregular-reflection sensor is used, the sensitivity of the sensor is typically adjusted to a predetermined level using a standard reflecting body prior to being installed in an apparatus, and is then adjusted again using an actual reflecting body, such as a photoconductive member, when the sensor is installed in the apparatus. However, when the surface of the photoconductive member has been damaged and the irregular-reflection sensor has such characteristics, for example, as indicated by the broken line in FIG. 7, if the sensor is adjusted by means of altering the intensity of light of the light-emitting device 10 so as to cause the output of the sensor relative to a part of the photoconductive member carrying no toner image to be the same as the one relative to a part of the photoconductive member not having been damaged, the output characteristics of the sensor may shift as indicated by the broken line in FIG. 9. As the diagram in FIG. 9 shows, the output characteristics of the sensor 205 shift vertically over the whole range, and thereby precise measurement of toner density can not be accomplished.

SUMMARY OF THE INVENTION

The present invention has been made in view of the above-discussed and other problems, and an object of the present invention is to provide a novel image forming apparatus and method that is capable of precisely detecting the amount of toner adhered to a toner image on an image carrier for controlling a toner supply operation to obtain a desired image quality.

Another object of the present invention is to provide a novel image forming apparatus that is capable of detecting a relatively large amount of toner adhered to a toner image on the image carrier.

A further object of the present invention is to provide a novel image forming apparatus that is capable of forming high quality images in a stable manner.

An image forming apparatus according to one embodiment of the present invention includes an image carrying device for forming and carrying a toner image thereupon. An image reading device optically reads an image to obtain image data of the image for output. An image processing device converts the image data, which is output by the image reading device, into printing image data. An image writing device writes a latent image on the image carrier according to the printing data. A developing device develops the latent image on the image carrier with toner to form a toner image. An image outputting device transfers the toner image, which is developed by the developing device on the image carrying device, to a transfer member and outputs the transfer member carrying the toner image. An internal pattern generating device generates a predetermined image pattern. A toner-amount measuring device measures the amount of toner adhered to a toner image of the predetermined image pattern that is formed on the image carrying device. A control device corrects a table to convert an output of the toner-amount measuring device into an amount of toner according to image density data of the toner image of the predetermined image pattern that is output by the image outputting device, the image density data being converted from image data obtained by reading, with the image reading device, the toner image of the internally generated predetermined image pattern that is output by the image outputting device.

In the above novel image forming apparatus of the present invention, the toner-amount measuring device may include an optical sensor that measures irregular reflection light from an object. Further, the control device may include a function to control image quality including gradation and/or toner concentration utilizing the corrected conversion table.

The above novel image forming apparatus of the present invention may further include a laser oscillator, and the internally generated image pattern can be formed with a substantially same condition as an immediately preceding image forming condition except that the latent image of the internally generated image pattern is written by the laser oscillator with a maximum output power of the laser oscillator.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIGS. 13(*a*) and 13(*b*) are diagrams showing exemplary conversion tables that convert an output of a toner-amount sensor into an amount of adhered toner, FIG. 13(*a*) for black toner, and FIG. 13(*b*) for color toners;

DESCRIPTION OF THE PREFERRED EMBODIMENTS

An electrophotographic color photocopier (hereinafter referred to as a color photocopier) as an example of an image forming apparatus according to an embodiment of the present invention is now described.

Figure 10:
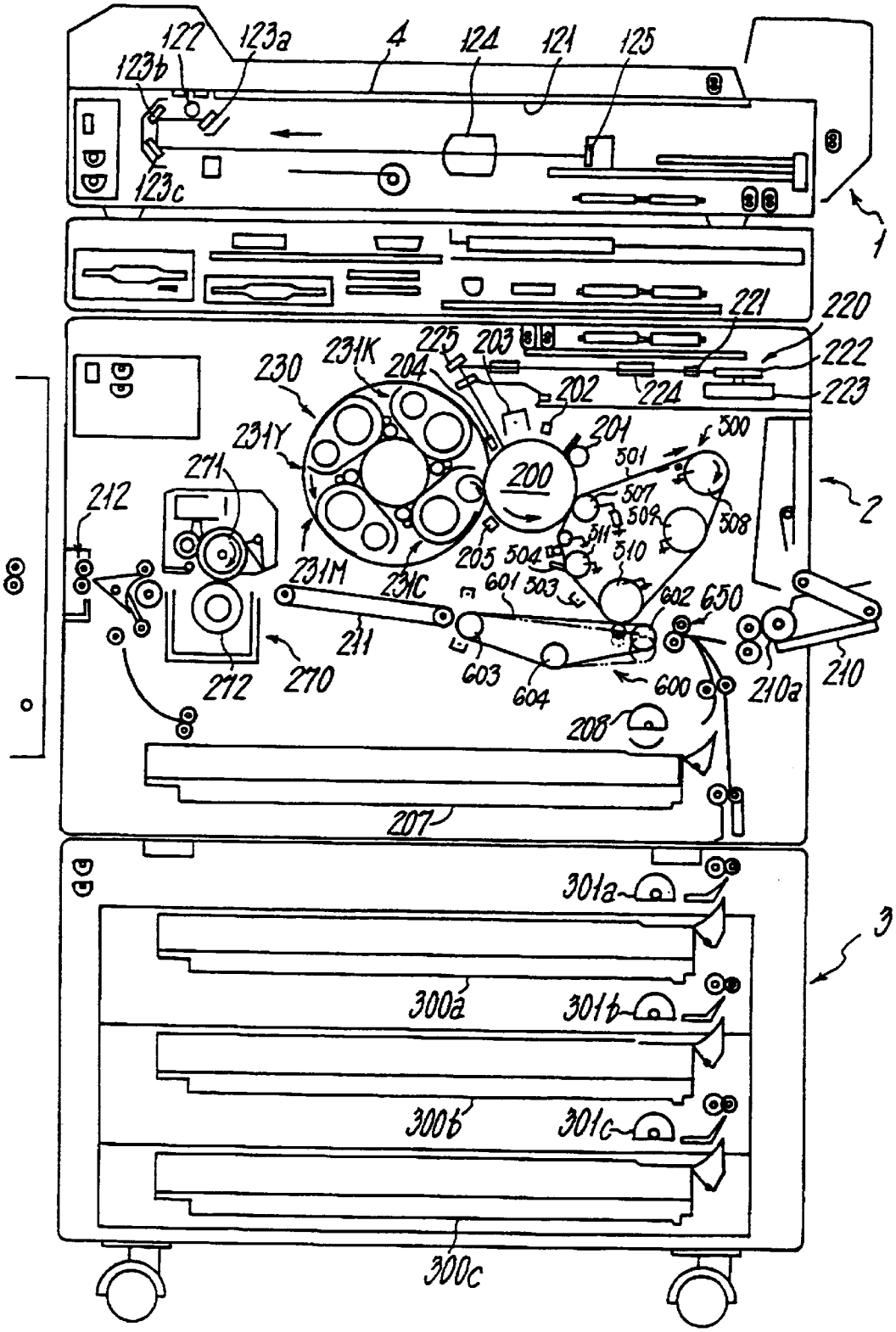
FIG. 10 is a schematic view illustrating a structure of a color photocopier as an example of an image forming apparatus according to the present invention.
Figure 11:
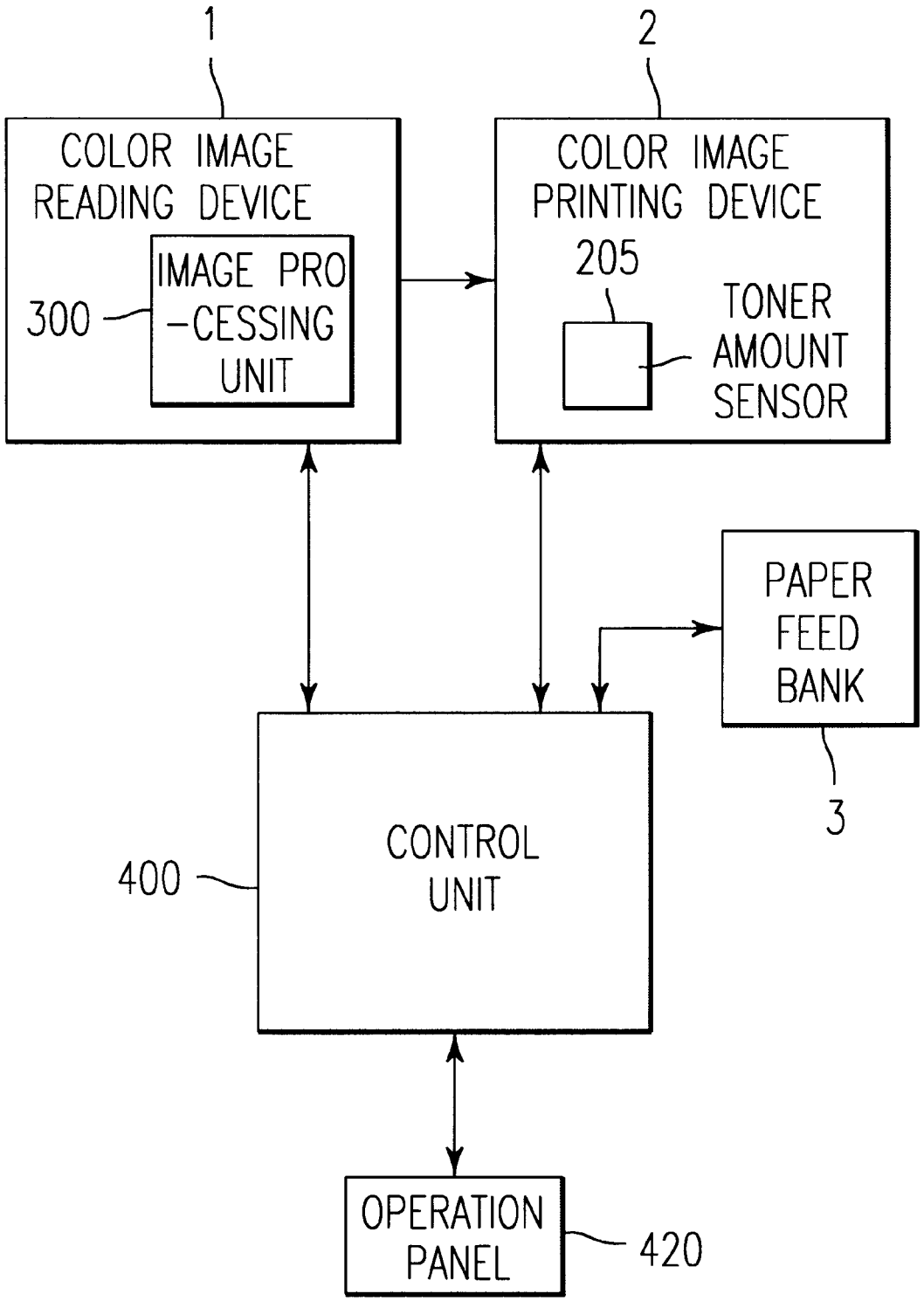
FIG. 11 is a block diagram of the photocopier shown in FIG. 10.

FIG. 10 illustrates an overall structure of the color photocopier, and FIG. 11 is a block diagram of the color photocopier shown in FIG. 10. The color photocopier includes a color image-reading device 1 (hereinafter referred to as a color scanner 1), a color image-printing device 2 (hereinafter referred to as a color printer 2), a control unit 400 (not shown in FIG. 10), an operation panel 420 (not shown in FIG. 10), and a paper feed bank 3.

Referring to FIG. 10, the color scanner 1 illuminates an original document 4 on a platen glass 121 with an illuminating lamp 122 to form an image of the original document 4 on a color sensor 125 through an imaging system including mirrors 123*a*, 123*b*, and 123*c*, and a lens 124. The color sensor 125 includes a color separating device that separates a received light into red (R), green (G), and blue (B) colors, and a photoelectric conversion device such as a charge coupled device (CCD), which converts each of the separated colors into electrical signals, simultaneously or in sequence.

An image-processing unit 300, which is located inside the color scanner 1 as shown in FIG. 11, converts the R, G, and B color signals into a set of color image data including black (Bk), cyan (C), magenta (M), and yellow (Y) image data for printing.

The image-processing unit 300 further includes a function to generate a pattern for a toner patch that is formed on a photoconductive member and the density of which is detected by the color sensor 125, and a function to convert image data of the toner patch which is obtained by the color scanner 1, after being formed on the photoconductive member and transferred therefrom onto a paper, into image density data and outputting the image density data to the control unit 400.

The color scanner 1 obtains a set of Bk, C, M, and Y color image data of the original document 4 in the following manner.

First, the color scanner 1 receives a start signal that is synchronous with an operation of the color printer 2, which is described later. The color scanner 1 then starts scanning the original document 4 by moving the optical system including the illuminating lamp 122 and mirrors 123*a*, 123*b*, and 123*c* in the direction indicated by an arrow in FIG. 10. The color scanner 1 obtains R, G, and B signals for processing the R, G, and B signals into Bk, C, M, and Y data. The above operations are repeated four times so to obtain a full set of Bk, C, M, and Y data.

Each time when the color scanner 1 obtains one of the Bk, C, M, and Y data, the color scanner 1 sends the data to the color printer 2. The color printer 2 forms a corresponding color toner image synchronously with receiving one of the Bk, C, M, and Y data, and repeats the image forming operation four times to overlay each color toner image with each other to form a full color toner image.

Figure 12:
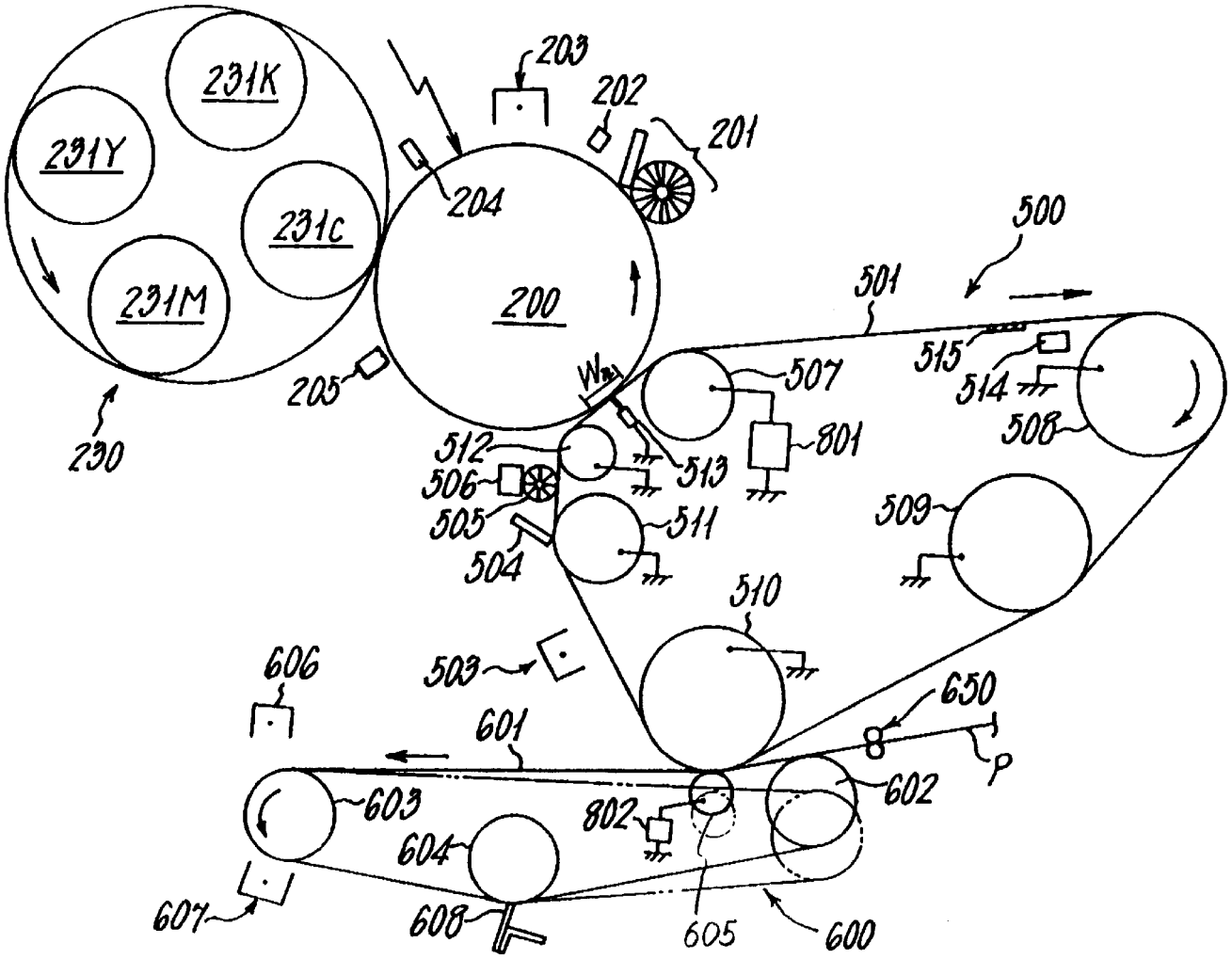
FIG. 12 is a schematic view illustrating a structure of a main portion of a color image-printing device of the photocopier shown in FIG. 10.

FIG. 12 illustrates the main portion of the color image-printing device 2 of the photocopier shown in FIG. 10. Again with reference to FIG. 10, the color printer 2 includes a photoconductive drum 200 as an image carrier, an optical writing unit 220, a revolver developing unit or a rotating developing unit 230, an intermediate transfer unit 500, a secondary transfer unit 600, a fixing unit 270, and so forth.

Referring to FIGS. 11 and 12, the photoconductive drum 200 rotates in a counter-clockwise direction as indicated by an arrow in FIGS. 11 and 12. A photoconductive drum cleaning device 201, a discharging lamp 202, a charger 203, an electric potential sensor 204, the revolver-developing unit 230 with one of a plurality of developing devices opposed to the drum 200, a toner-amount sensor 205 that measures the amount of toner of a toner patch on the photoconductive drum 200, and the intermediate transfer unit 500 are arranged around the photoconductive drum 200. The secondary transfer unit 600 is located beneath the intermediate transfer unit 500.

The optical writing unit 220 converts color image data from the color scanner 1 into optical signals, and exposes the photoconductive drum 200 with the optical signals to form a latent image corresponding to the image of the original document 4. The optical writing unit 220 exposes a toner patch pattern that is generated by the image-processing unit 300 as well. The optical writing unit 220 includes a laser diode 221 as a light source, a laser driver controller (not shown), a polygonal mirror 222 for deflecting a laser light emitted from the light source so as to scan the surface of the photoconductive drum 200, a motor 223 for driving the polygonal mirror 222, an f-theta lens 224, and a reflecting mirror 225.

The revolver-developing unit 230 includes a black-developing device 231K, a cyan-developing device 231C, a magenta-developing device 231M, a yellow-developing device 231 Y, and a rotating unit (not shown) for rotating the revolver-developing unit 230 in a counter-clockwise direction as indicated by an arrow in FIG. 10 to locate one of the color developing devices 231K, 231C, 231M, and 231Y at a position opposed to the drum 200. Each of the color-developing devices 231K, 231C, 231M, and 231Y can use as a developer two-component color developer-mix, which is, e.g., a mixture of ferrite carrier powder and color toner powder. Each of the developing devices 231K, 231C, 231M, and 231Y includes a rotating developing sleeve for forming thereupon a brush of the color developer-mix to contact the surface of the drum 200 for developing the latent image on the drum 200 with toner. Each of the developing devices 231K, 231C, 231M, and 231Y further includes a rotating paddle to agitate the developer-mix in the developing device and pump up the developer-mix onto the rotating developing sleeve. The two-component color developer-mix in each of the developing devices 231K, 231C, 231M, and 231Y is agitated with the paddle, so that friction between the toner and the ferrite carrier causes the toner to be charged with negative electricity. Further, a negative voltage Vdc superimposed with an alternative voltage Vac is applied to each developing sleeve by a power supply (not shown) to bias the sleeve at a predetermined voltage relative to the metal substrate of the photoconductive drum 200.

When the photocopier is in a waiting condition, the revolver-developing unit 230 is positioned to cause the developing sleeve of the black developing device 231K to be located 45 degrees ahead of the developing position, where the developing sleeve of the developing device faces the drum 200. When a copying operation starts, the color scanner 1 starts reading an image of an original document by moving the optical system to a predetermined position to output black data for printing, and the color printer 2 starts to form a latent image on the photoconductive drum 200 based on the black data by the laser diode 221. A latent image according to black data is hereinafter referred to as a black latent image, and similarly a cyan latent image according to cyan data, a magenta latent image according to magenta data, and a yellow latent image according to yellow data are referred to as cyan, magenta, and yellow latent images, respectively.

The revolver-developing unit 230 is rotated to cause the developing sleeve of the black developing device 231K to face the photoconductive drum 200 before the leading edge of the black latent image area reaches the developing position. The developing sleeve of the developing device 231K is rotated to develop the black latent image with black toner. As soon as the trailing edge of the black latent image passes the developing position, the revolver-developing unit 230 is rotated to cause the developing sleeve of the developing device for a next color to be located at the developing position. The above rotation of the developing unit 230 is completed before the next color latent image reaches the developing position.

The intermediate transfer unit 500 includes an intermediate transfer belt 501, which is spanned around a plurality of rollers 507–512. A secondary transfer belt 601 of the secondary transfer unit 600 as a carrying member for an image transfer member, a secondary transfer bias roller 605 as a secondary transfer charge applying device, a cleaning blade 504 for cleaning the intermediate transfer belt 501, and a lubricant applicator brush 505 as a lubricant applying device are arranged around the intermediate transfer belt 501, each being opposed to the intermediate transfer belt 501. In addition, a mark 515 for detecting a position of the intermediate transfer belt 501 is provided on either the external or the internal circumference surface of the intermediate transfer belt 501. In this embodiment, the position detect mark 515 is provided on the internal circumference surface of the intermediate transfer belt 501 to avoid the cleaning blade 504 of the belt cleaning device peeling off the mark 515 or soiling the mark 515 with toner. Further, an optical sensor 514 to detect the mark 515 is placed inside the intermediate transfer belt 501 and between a primary transfer bias roller 507 and a belt drive roller 508 around which the intermediate transfer belt 501 is spanned.

The intermediate transfer belt 501 is spanned around the primary transfer bias roller 507 as a primary transfer charge applying device, the belt drive roller 508, a belt tension roller 509, a secondary transfer unit opposing roller 510, a cleaning device opposing roller 511, and a ground roller 512. Each of these rollers, except the primary transfer bias roller 507, is electrically conductive and grounded to the chassis of the photocopier. The primary transfer bias roller 507 is connected to a primary transfer power supply 801, and a transfer bias, which is controlled at a constant current or a constant voltage and which is changed according to the number of overlaid color toner images, is applied to the primary transfer bias roller 507 from the power supply 801. In addition, the intermediate transfer belt 501 is rotated clockwise as shown in FIGS. 10 and 12 by a drive motor (not shown) via the belt drive roller 508. Further, the intermediate transfer belt 501 can be made of a medium resistance material or an insulating material, and is formed in a single or a multiple layer structure.

A transfer portion where a toner image on the photoconductive drum 200 is transferred to the intermediate transfer belt 501 is hereinafter referred to as a primary transfer portion or a belt transfer portion. The intermediate transfer belt 501 is spanned around the primary transfer bias roller 507 and the ground roller 512 to cause a portion of the intermediate transfer belt 501 to be pressed against the photoconductive drum 200 and to form a nip having a predetermined width between the photoconductive drum 200 and the intermediate transfer belt 501 at the primary transfer portion. Further, a belt discharging brush 513 as a discharging device for the primary transfer portion is arranged to contact the internal circumference surface of the intermediate transfer belt 501. Furthermore, the width of the nip and the distance between the downstream boundary of the nip in the belt traveling direction (indicated by an arrow) and the position where the belt discharging brush 513 contacts the belt 501 are respectively adjusted to provide a predetermined transfer condition, including a condition for a transfer bias voltage applied to the nip by the primary transfer power supply 801 via the primary transfer bias roller 507.

The lubricant applicator brush 505 can abrade a zinc stearate bar (not shown) and apply abraded zinc stearate microparticles onto the intermediate transfer belt 501. The lubricant applicator brush 505 is configured to contact or separate from the intermediate transfer belt 501, and is controlled to contact the intermediate transfer belt 501 at a predetermined timing.

The secondary transfer unit 600 includes three supporting rollers 602, 603, and 604, around which the secondary transfer belt 601 is spanned such that a section between the supporting rollers 602 and 603 of the secondary transfer belt 601 is pressed against the intermediate transfer belt 501 at the position where the counter secondary transfer roller 510 contacts the intermediate transfer belt 501. One of these rollers 602, 603, and 604 is a drive roller, which is driven by a driving device (not shown) to drive the secondary transfer belt 601 in a counter-clockwise direction as indicated by the arrow in FIG. 12.

A secondary transfer bias roller 605, which functions as a secondary transfer device, is placed opposing the counter secondary transfer roller 510 to sandwich the intermediate transfer belt 501 and the secondary transfer belt 601, and a transfer bias at a predetermined constant current is applied to the secondary transfer bias roller 605 by a secondary transfer power supply 802, which is controlled to output a constant current. Further, a contact/separate mechanism (not shown) moves the secondary transfer belt 601 between positions at which the secondary transfer belt 601 contacts the intermediate transfer belt 501 and separates from the intermediate transfer belt 501 respectively. The secondary transfer belt 601 is placed in the position to contact the intermediate transfer belt 501 when the toner image on the intermediate transfer belt 501 is transferred onto the transfer paper P carried by the secondary transfer belt 601. The secondary transfer belt 601, the supporting roller 602, and the secondary transfer bias roller 605 are moved to the position to separate the secondary transfer belt 601 from the intermediate transfer belt 501 by the contact/separate mechanism at times other than when transferring the toner image on the intermediate transfer belt 501 to the transfer paper P. The positions of the secondary transfer belt 601, the supporting roller 602, and the secondary transfer bias roller 605 at the separated position are respectively indicated by alternate long and two dots lines in FIG. 12.

Reference numeral 650 denotes a pair of register rollers, which are driven and controlled to cause a sheet of transfer paper P as a transfer member to be fed into the nip formed between the intermediate transfer belt 501 and the secondary transfer belt 601 at a predetermined timing.

Around the supporting roller 603, which is located at the side of a fixing device 270, a paper discharger 606 as a transfer paper discharging device and a belt discharger 607 as a secondary transfer belt discharging device are placed, each opposing the supporting roller 603. In addition, a cleaning blade 608 as a cleaning device for the secondary transfer belt 601 abuts against the secondary transfer belt 601 at a position opposing the supporting roller 604.

The paper discharger 606 discharges the electric charge retained on the transfer paper P to enable the transfer paper P to be separated from the secondary transfer belt 601 with its own bouncing strength. The belt discharger 607 discharges the electric charge which remains on the secondary transfer belt 601, and the cleaning blade 608 removes a residue on the surface of the secondary transfer belt 601.

After a start of an image forming process of the color photocopier, the photoconductive drum 200 is rotated by a drum drive motor (not shown) counter-clockwise as indicated by the arrow in FIGS. 10 and 12, and the intermediate transfer belt 501 is rotated by a belt drive motor (not shown) via a belt drive roller 508 at the same surface velocity as the drum surface velocity in a clockwise direction as indicated by the arrow in FIGS. 10 and 12.

The optical sensor 514 as a mark detecting device to detect the mark 515 is arranged at a predetermined position past which the intermediate transfer belt 501 passes. The optical sensor 514 is attached to a stationary member (not shown) of the photocopier. The optical sensor 514 may be, e.g., a reflection type optical sensor or a transparent type optical sensor. When a transparent type optical sensor is used, a small hole is opened at an edge of the intermediate transfer belt 501 to selectively pass the light of the sensor. When a refection type optical sensor is used, a piece of reflection tape, such as a detecting mark 515, is stuck on the surface of the intermediate transfer belt 501. As described above, the intermediate transfer belt 501 has the mark 515 on its internal circumference surface in this embodiment. The mark 515 moves simultaneously with the intermediate transfer belt 501. In addition, the mark 515 has a reflection factor, which is higher than that of the intermediate transfer belt 501. The optical sensor 514 detects the mark 515 passing thereby by sensing a reflecting light intensity change caused by the belt surface and the mark surface.

A black toner image is first formed on the photoconductive drum 200, which is then transferred to the intermediate transfer belt 501 by a bias voltage that is applied to the primary transfer bias roller 507. Then, a cyan toner image is formed on the photoconductive drum 200 and is transferred to the intermediate transfer belt 501, being superimposed on the black image that has been previously transferred. Likewise, a magenta toner image is superimposed on the cyan toner image and a yellow toner image is superimposed on the magenta toner image on the intermediate transfer belt 501. Thus, a four-color or a full color image is formed on the intermediate transfer belt 501.

In greater detail, the black toner image is formed in the following manner. The charger 203 uniformly charges the surface of the photoconductive drum 200 to a predetermined negative electric charge by corona discharging. The optical writing unit 220 exposes the photoconductive drum 200 with a laser raster image according to the black data after a predetermined time from a time the mark 515 is detected by the optical sensor 514. The black data is converted from the R, G, and B image data of an original document, which is obtained by the color scanner 1 and temporarily stored in a memory (not shown) in the image-processing unit 300. The exposed photoconductive drum 200 loses the electric charge by a unit of a picture element or a pixel proportionally to the intensity of exposure, and thereby the black latent image is formed.

The black developing device 230K of the revolver-developing unit 230 develops the black latent image with black toner by applying negatively charged black toner carried around the developing sleeve of the developing device 230K onto the black latent image. The portion of the photoconductive drum 200 where the electric charge is removed attracts the toner, and the portion where the electric charge remains does not attract the toner, and thus a black toner image corresponding to the black latent image is formed.

The black toner image on the photoconductive drum 200 is transferred to the intermediate transfer belt 501 which is moving at the same velocity as that of the surface of the photoconductive drum 200 with the surface of the intermediate transfer belt 501 contacting the photoconductive drum 200. This transfer of a toner image from the photoconductive drum 200 to the intermediate transfer belt 501 as described above is referred to as a belt transfer or a primary transfer.

After the belt transfer, residual toner on the photoconductive drum 200 is removed by the cleaning device 201, and then the photoconductive drum 200 is discharged by the discharging lamp 202 to be prepared for a next image forming operation.

A cyan latent image is then formed on the photoconductive drum 200 according to cyan data, which is converted from the R, G, and B image data of the original document in the memory of the image-processing unit 300, in substantially the same manner as described above for the black latent image.

After the black latent image passes and before the leading edge of the cyan latent image area reaches the developing position, the revolver-developing unit 230 is rotated to cause the developing sleeve of the cyan developing device 231C to face the photoconductive drum 200, and then the cyan developing device 231C starts developing the cyan latent image on the photoconductive drum 200. The formed cyan toner image is then transferred to the intermediate transfer belt 501, being superimposed on the black toner image that has been previously transferred.

Likewise, a magenta toner image according to magenta data is superimposed on the cyan image and a yellow toner image according to yellow data is superimposed on the magenta image, and thus, a full color toner image is formed on the intermediate transfer belt 501.

When an image forming process starts, a transfer paper P is fed out from one of cassettes 300*a*, 300*b*, 300*c* that are installed in the paper supply bank 3 or from a manual paper tray 210, and is conveyed to the nip of the pair of register rollers 650, and then waits there to be further fed. Before the leading edge of the full color toner image on the intermediate transfer belt 501 is conveyed to the nip between the intermediate transfer belt 501 and the secondary transfer belt 601, the transfer paper P is fed by the pair of register rollers 650 to cause its leading edge to meet the leading edge of the full color toner image on the intermediate transfer belt 501 at a secondary transfer nip. The transfer paper P passes through the secondary transfer nip in contact with the toner image on the intermediate transfer belt 501. The toner image is transferred to the transfer paper P by a voltage applied to the secondary transfer bias roller 605 from the secondary transfer power supply 802.

After the secondary transfer, when the transfer paper P passes under the paper discharger 606, the transfer paper P is discharged and separated from the secondary transfer belt 601 with its own bouncing strength. The paper P is then fed toward the nip between an upper fixing roller 271 and a lower fixing roller 272 of the fixing device 270. When the transfer paper P is conveyed through the fixing device 270, the toner image on the paper P is melted and fixed on the paper P, and then the paper P is ejected from the photocopier body by a pair of exit rollers 212. The paper P is then stacked with the surface carrying the image facing up on a stacking tray (not shown).

The photoconductive drum 200 is cleaned by the cleaning device 201 and is uniformly discharged by the discharging lamp 202 after transferring each color toner image to the intermediate transfer belt 501. Further, residual toner on the intermediate transfer belt 501 is removed by the cleaning blade 504 that is pressed against the intermediate transfer belt 501 by the contact/separate mechanism (not shown).

When the image forming operation is repeated for a same original (i.e., when making multiple copies of an original), the second image forming process for a black latent image for the second copy starts following the cleaning of residual yellow toner from the photoconductive drum 200 for the first copy. The black toner image is then transferred to the intermediate transfer belt 501 from which the preceding four-color toner image of the first copy has been transferred to the transfer paper P and from which the residual toner has been removed by the cleaning blade 504. Following the black toner image, substantially the same process as for the first copy is repeated for subsequent colors.

The image forming operation is performed as described above for a four-color or full color reproduction. For a three-color or two-color reproduction, the image forming operation is performed a number of times corresponding to the number of colors, for example, three times for a three-color reproduction.

For a single-color copy reproduction, the image forming operation is performed such that only one of the developing devices 231K, 231C, 231M, and 231Y for a specified color is kept at the developing position and the cleaning blade 504 is kept pressed against the intermediate transfer belt 501 by the contact/separate mechanism (not shown) until a set number of copies are completed.

Next, a method for a toner supply control according to an embodiment of the present invention is described.

The toner supply control operation is performed by the toner-amount sensor 205 and the control unit 400.

The toner-amount sensor 205 measures the amount (or the density) of toner adhered to a toner patch 20 formed on the photoconductive drum 200, and then sends the output to the control unit 400. The control unit 400 may include a micro computer system having a central processing unit (CPU), an input-output circuit, a random access memory (RAM) with a battery-backup, a read only memory (ROM), a clock counter, a timer and a control circuit, which are not shown. The control unit 400 controls the amount of toner supplied to the developing devices 231K, 231C, 231M, and 231Y from a toner bottle (not shown) according to the amount of toner adhered to a toner image measured by the toner-amount sensor 205. The control unit 400 can also control the operation of each part of the photocopier according to input data input by an operation via an operation panel 420 and input from various sensors (not shown) provided in various parts of the photocopier.

Figure 4:
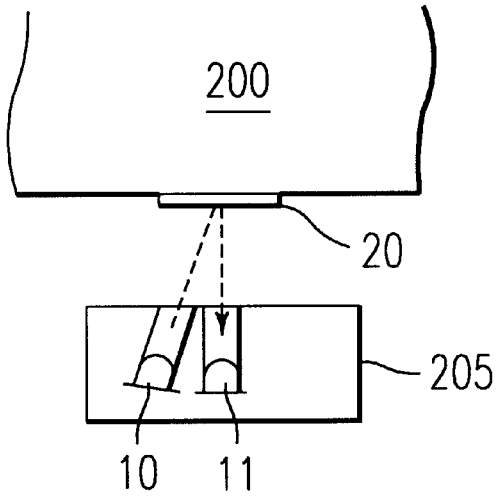
FIG. 4 is an illustration showing a schematic of an exemplary irregular-reflection toner-amount sensor.
Figure 5:
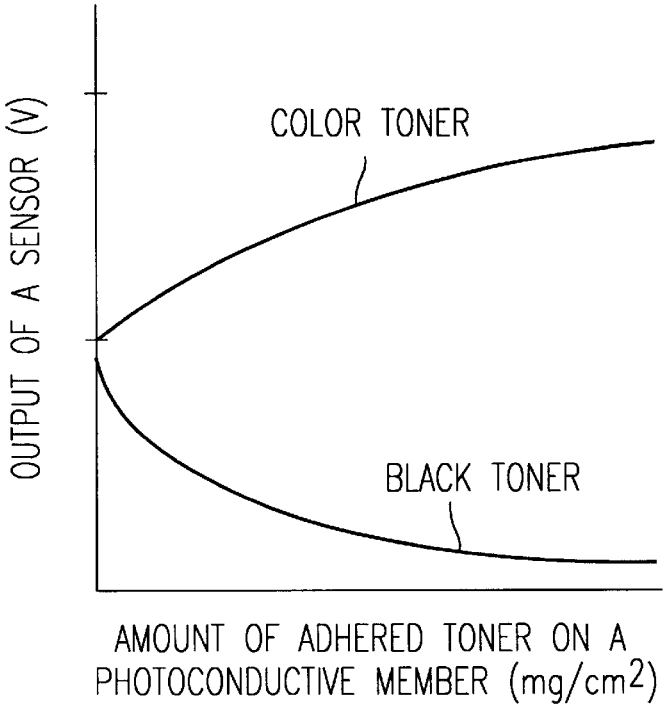
FIG. 5 BACKGROUND ART
FIG. 5 is a diagram that shows a relation between the amount of adhered toner and the output of the irregular-reflection toner-amount sensor of FIG. 4.
Figure 6:
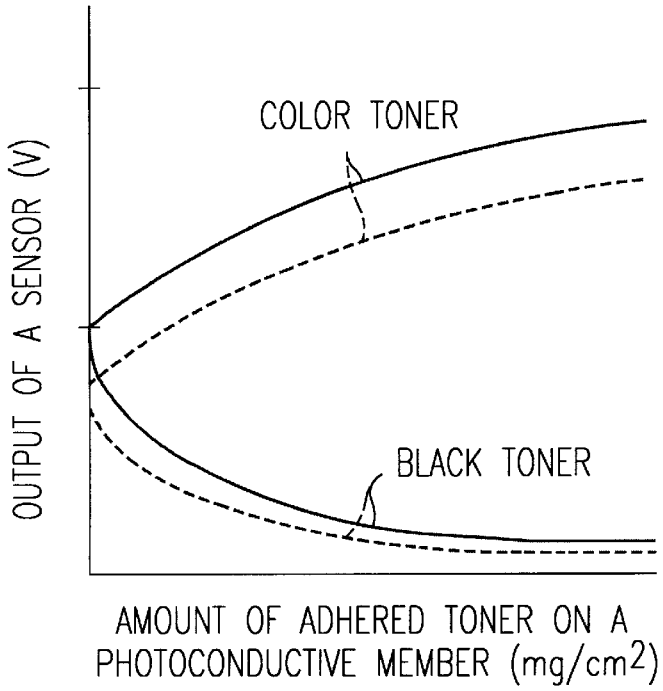
FIG. 6 BACKGROUND ART
FIG. 6 is a diagram that shows a change of output characteristics of the irregular-reflection toner-amount sensor of FIG. 4, showing output characteristics when a light-emitting device or a light-receiving device are stained with scattered toner with a broken line, and showing output characteristics when the devices are not stained with a solid line.
Figure 7:
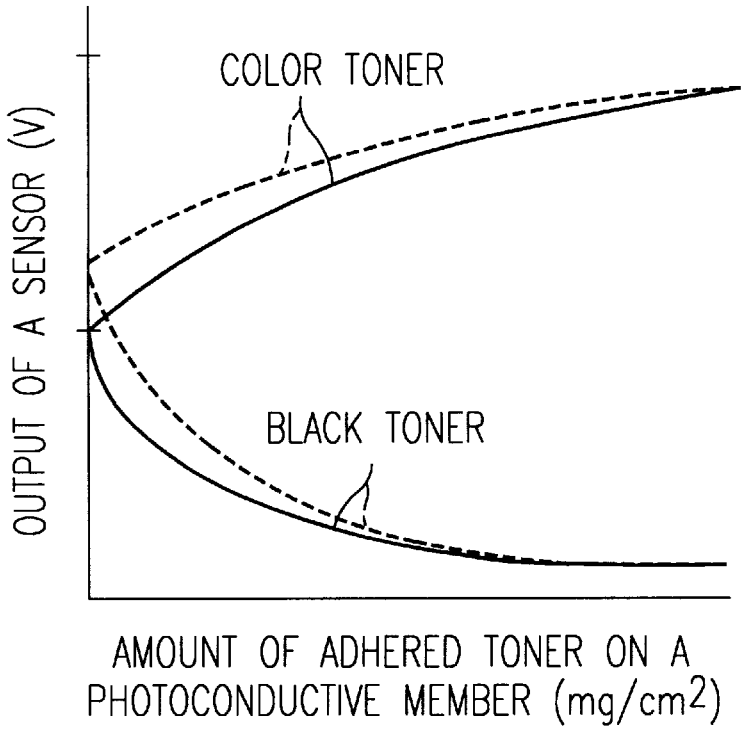
FIG. 7 BACKGROUND ART
FIG. 7 is a diagram that shows a change of output characteristics of the irregular-reflection toner-amount sensor of FIG. 4, showing output characteristics when reflection characteristics of a photoconductive member surface are changed with a broken line, and showing output characteristics when the reflection characteristics of the photoconductive member surface are not changed with a solid line.
Figure 8:
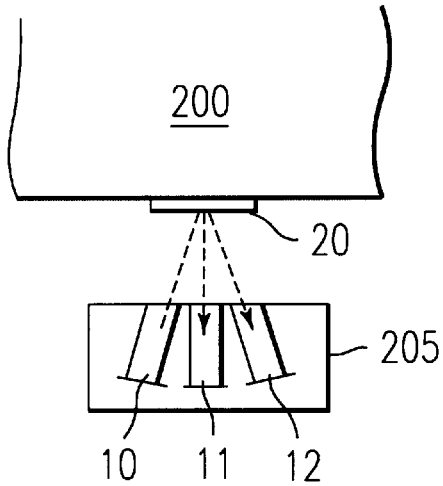
FIG. 8 BACKGROUND ART
FIG. 8 is an illustration showing a schematic of an exemplary toner-amount sensor that senses both mirror-reflection and irregular-reflection light.
Figure 9:
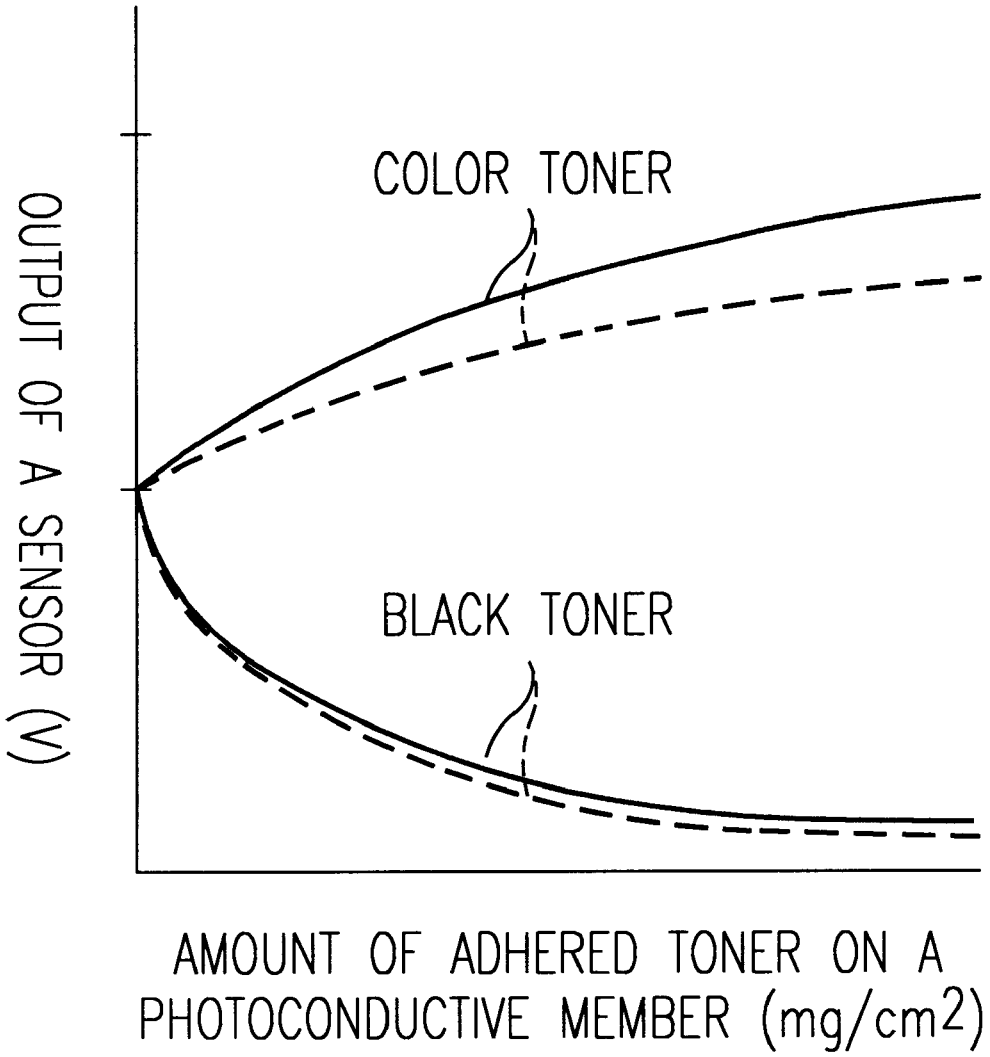
FIG. 9 BACKGROUND ART
FIG. 9 is a diagram in which the irregular-reflection sensor adjusted by means of altering the intensity of light of a light-emitting device so as to cause an output of a sensor relative to a part of the photoconductive member carrying no toner image to be the same as one relative to a part of the photoconductive member not having been damaged, and showing output characteristics of the sensor shifting vertically over the whole range with a broken line, and showing output characteristics relative to a part of the photoconductive member having no damage with a solid line.

As the toner-amount sensor 205, an irregular-reflection type sensor, such as shown in FIG. 4, is used in this embodiment, although clearly other structures can be used for toneramount sensor 25. The light-emitting device 10 emits a 900 nm wavelength infrared light. An example of the output characteristic curve of the toner-amount sensor 205 is shown in FIG. 5.

Although only one toner-amount sensor 205 is used in this embodiment, two toner-amount sensors can be used so that one sensor is optimized for black toner and the other sensor is optimized for color toner by adjusting each gain, at predetermined levels respectively.

Hereinafter, "Vsg" represents a sensor output voltage relative to the surface of the photoconductive drum 200 where no toner image exists, and"Vsp" represents a sensor output voltage relative to the surface of the photoconductive drum 200 where a toner image exists. The sensor output voltage Vsg fluctuates according to a change in the characteristics of the light-emitting device 10 and/or the light-receiving device 11, which is caused, for example, when the devices 10 and/or 11 are stained by toner. A change in environmental conditions, such as a temperature change or the deterioration of the sensor 205 itself due to the long usage (aging), also changes the sensor output Vsg. A change in the reflection characteristics of the surface of the photoconductive drum 200 also changes the sensor output Vsg. Therefore, in the embodiment, the output Vsg is controlled, using a dichotomizing search method, to be in the range 2V±0.05V, by feeding back the sensor output and by adjusting the intensity of the light-emitting device 10 at every power-on sequence of the photocopier.

Figure 1:
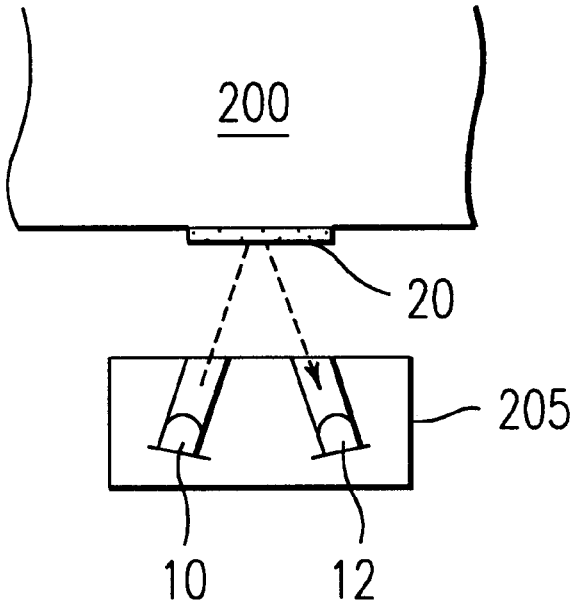
FIG. 1 BACKGROUND ART
FIG. 1 is an illustration showing a schematic of an exemplary mirror-reflection toner-amount sensor.
Figure 2:
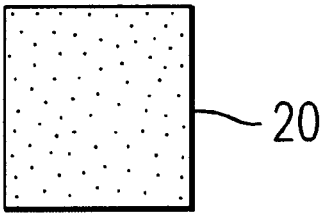
FIG. 2 BACKGROUND ART
FIG. 2 is an illustration showing a square toner patch pattern as an example of an internally generated toner patch pattern.
Figure 3:
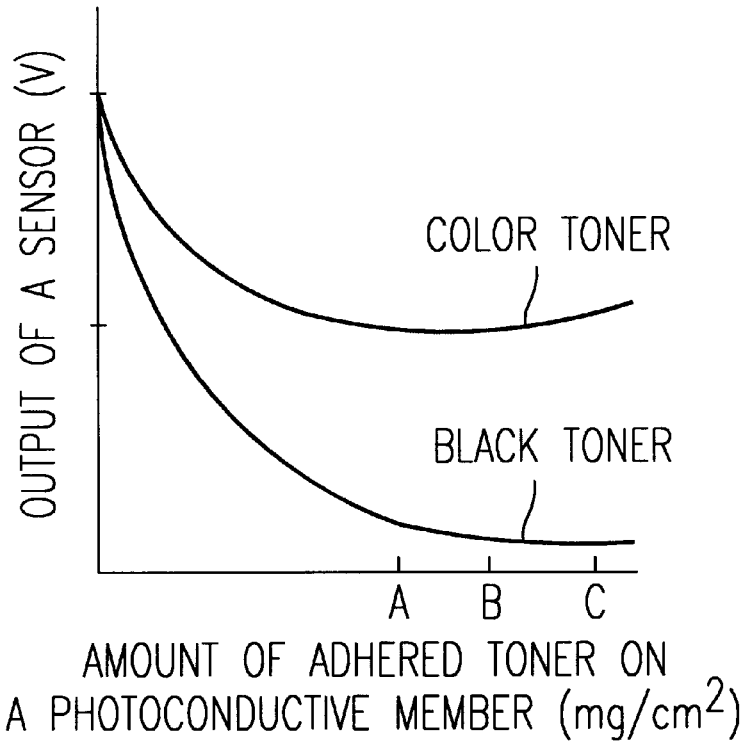
FIG. 3 is a diagram that shows a relation between the amount of adhered toner and the output of the mirror-reflection toner-amount sensor of FIG. 1.

A toner patch for measuring the amount of adhered toner is formed during each image forming process on the photoconductive drum 200 in a non-image area on the photoconductive drum 200, that is, in an area between toner image forming areas, and at the width-wise center on the photoconductive drum 200 for controlling the toner supply operation. However, when a process for correcting a table to convert an output of the sensor 205 into an amount of toner, which is described later, is performed, the toner patch 20 is formed inside an image forming area on the photoconductive drum 200. The toner patch 20 is formed, for example, in a 20 mm by 20 mm square, as illustrated in FIG. 2. The toner patch 20 is generated by the image-processing unit 300 shown in FIG. 11, and the photoconductive drum 200 is exposed by a light emitted by the laser diode (LD) 221 of the optical writing unit 220, and thereby the latent image of the toner patch 20 having the generated toner pattern is formed on the photoconductive drum 200. Exposing the photoconductive drum 200 by the laser diode (LD) 221 is hereinafter referred to as LD writing on the photoconductive drum 200.

The LD writing on the photoconductive drum 200 typically enables writing each picture element or pixel at 256 different levels of light intensity utilizing both a pulse-width and an amplitude modulation. The level of the light intensity is set from a level 0 (i.e., no exposing light) through a level 255 with the maximum light intensity in ascending numeric order.

The image forming conditions for the toner patch 20, such as a charging potential of the photoconductive drum 200 and a bias voltage on the developing devices 230, are substantially the same as for an ordinary image forming operation. However, the light intensity of the laser diode 221 is set to the full intensity (level 255) or to at least the half intensity (level 128) of the laser diode 221.

A latent image of a toner patch 20 that is formed at the width-wise center and in a non-image area between image area is developed by a predetermined one of the four developing devices 231K, 231C, 231M, and 231Y as in the ordinary image forming operations. Then, the toner-amount sensor 205 measures the developed toner patch 20 and outputs a voltage for the measured amount of toner adhered to a toner image of the toner patch 20.

More specifically, referring to the FIG. 4, the light-emitting device 10 synchronously emits light onto the moving toner patch 20 on the photoconductive drum 200 and the light-receiving device 11 measures the irregular-reflection light from the toner patch 20 and outputs a voltage corresponding to the intensity of the received irregular-reflection light as Vsp. The control unit 400 calculates the difference between the values of Vsp and Vsg, which is preliminarily measured in the power-on sequence and stored in the RAM of the control unit 400, as an output voltage for the surface of the photoconductive drum 200 where no toner image is carried, and then converts the difference into an amount of toner adhered to a toner image by using a conversion table shown in FIG. 13. The amount of toner adhered to a toner image is expressed by weight per a unit area dimension, such as, for example, $mg/cm^2$.

The conversion table is preliminarily prepared based on experimental results and is written in the RAM of the control unit 400 at a production line. FIG. 13 (*a*) shows an example of the conversion table for black toner, and FIG. 13(*b*) for color toner, each including, e.g., 101 conversion pairs of the difference (Vsg−Vsp) vs. the amount of adhered toner ($mg/cm^2$). An approximation, such as a polynomial, can also be utilized to convert a difference (Vsg−Vsp) into the amount of adhered toner ($mg/cm^2$) without using the conversion table as long as the calculation error is little.

The control unit 400 controls the image forming operation including the toner supply operation and a gradation control according to the amount of toner adhered to a toner image on the photoconductive drum 200, which is measured as described above. As long as the output characteristics of the toner-amount sensor 205 remain as shown in FIG. 5, the toner supply operation is controlled in a desired manner such that a desired image quality is obtained. In general, the characteristics of the toner-amount sensor 205 remain the same for some ten or hundred thousand copies. After some ten or hundred thousand copies are made, however, the output characteristics of the toner-amount sensor 205 may be fluctuated due to various factors, such as the sensor 205 being stained by toner, fine scratches having been made on the photoconductive drum 200, etc., as described above. Consequently, an accurate measuring of the amount of toner adhered to a toner image becomes difficult.

On the other hand, the color scanner 1 for reading an image of an original is hardly affected by scattered particles, such as toner, because the color scanner 1 is isolated from the color printer 2 and does not generate almost any pollutant by itself. Therefore, the color scanner 1 is typically able to read optical characteristics of a toner image on a transfer paper P, including the density of the toner, by scanning the paper P carrying the toner image thereupon which is placed on the platen glass 121 of the color scanner 1 with the surface carrying the toner image facing downward. The density of toner fixed on the transfer paper P has a close relation to the density of toner that has been utilized for developing the same toner image and the amount of toner adhered to the toner image on the photoconductive drum 200 when the image is developed.

Accordingly, in order to measure the amount of toner adhered to a toner image on the photoconductive drum 200 in a precise manner even when the toner amount sensor 205 is stained by toner or the photoconductive drum 200 is scratched, the photocopier according to the present invention includes a function to correct a table to convert the output voltage of the toner-amount sensor 205 into an amount of toner using data for a toner patch that is formed on the photoconductive drum 200, transferred to a transfer paper P, and then read by the color scanner 1. Data for the toner patch, such as image density data, is extracted by the image-processing unit 300 when the toner patch is read by the color scanner 1.

The image density data is converted into the amount of toner adhered on the paper P per unit area for each color using a conversion table (not shown) by the control unit 400 as described later. The conversion table is preliminarily prepared based on experimental results utilizing a standard paper that has an appropriate optical characteristics for detecting the density of an image thereupon. The conversion table is then written in the ROM or RAM of the control unit 400 at a production line.

Referring to FIG. 10, the color scanner 1 illuminates a toner image carried on a transfer paper P which is placed on a platen glass 121 with an illuminating lamp 122 for detecting the density of the toner image on the transfer paper P. Where the toner exists, the illuminating light transmits through the toner layer, is reflected on the surface of the transfer paper P, transmits through the toner layer, and then is received by the color sensor 125. Where no toner exists, the illuminating light is directly reflected on the surface of the transfer paper P, and is then received by the color sensor 125. The color sensor 125 separates the received light into R, G, and B colors, and converts each of the separated color light into electrical signals. As the transfer paper P, various kinds of paper, which have different reflection characteristics from that of a standard paper, may be used. If the toner patch is formed in a half-tone image, such that some parts of the toner patch carry no toner, and on paper having optical characteristics different from those of the standard paper, the sensor 125 receives the light directly reflected on the surface of the paper P. As a result, the difference of the reflection characteristics between the standard paper and the transfer paper P used for detecting the density of the toner image on the paper P exerts influence upon the density detection. Therefore, the toner patch in this embodiment is formed with all pixels inside the patch exposed with a maximum powered LD writing level so as to form a thick and solid patch, such that the color scanner 1 precisely detects the density of toner fixed on the transfer paper even when paper having optical characteristics different from those of the standard paper is used as the transfer paper P.

Figure 14:
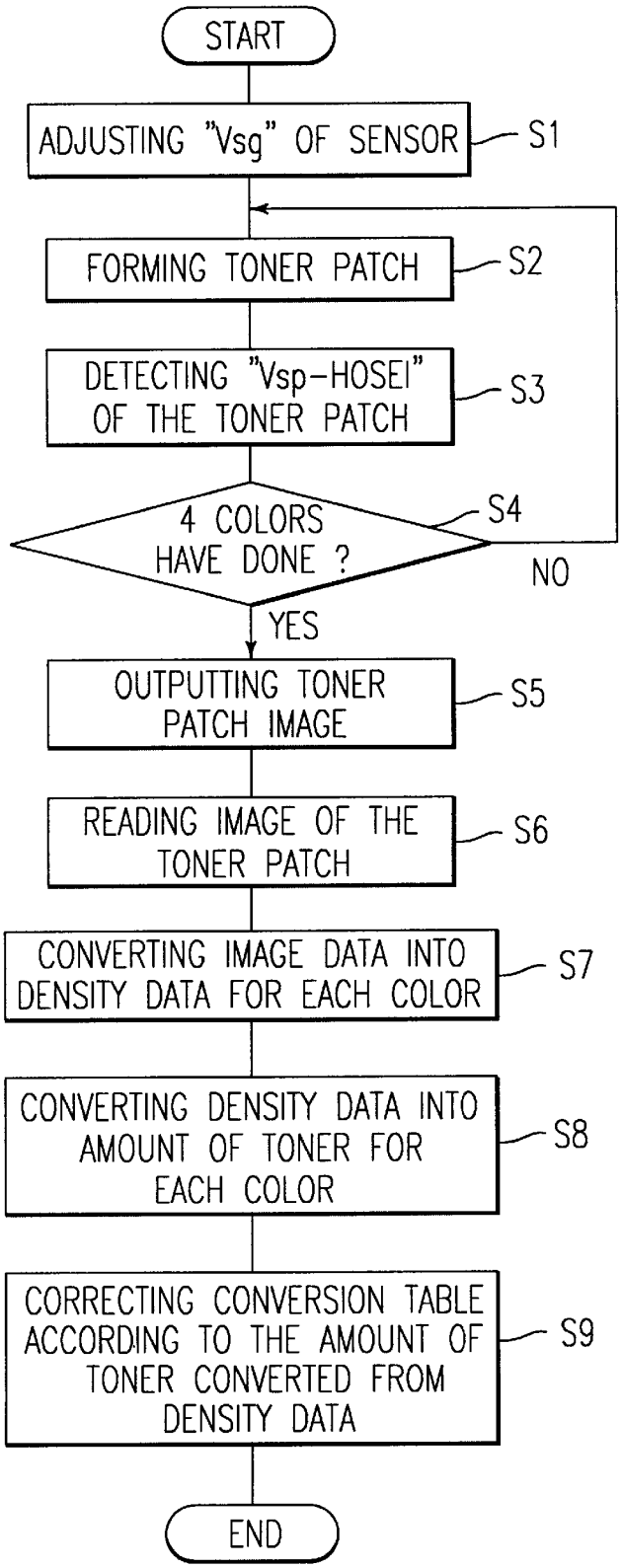
FIG. 14 is a flowchart showing an exemplary operation for correcting a conversion table in accordance with the output of a scanner according to the present invention.

FIG. 14 is a flowchart illustrating an example of a process for correcting the table to convert an output voltage of the toner-amount sensor 205 into an amount of toner for the amount of toner adhered to a toner image on the photoconductive drum 200 according to the present invention. A program that executes the process illustrated in FIG. 14 is preliminarily installed in the ROM of the control unit 400. The program is executed in response to an input from an "image density correction" key of the operation panel 420, which is manipulated by an operator. This correcting process may be periodically executed, for example, after every some ten or hundred thousand copies, or when reduction in the image density is observed.

Referring now to FIG. 14, in step S1, the Vsg value, which is an output from the toner-amount sensor 205 relative to the surface of the photoconductive drum 200 where no toner exists, is adjusted to be in the range 2V±0.05V when none of the developing devices 231K, 231C, 231M, and 231Y is located in the developing position facing the photoconductive drum 200. This process is executed in substantially the same manner as the process of adjusting Vsg that is executed at every power-on sequence of the photocopier as described above.

In step S2, a toner patch is formed by the image-processing unit 300, the laser diode (LD) 221, one of the developing devices and so forth, as described earlier. In this step, one of the four color developing devices 231K, 231C, 231M, and 231Y is moved to a position to face the photoconductive drum 200 before the latent image of the toner patch is formed on the photoconductive drum 200. A toner patch pattern 20 shown in FIG. 2 is generated by the image-processing unit 300, and the latent image of the toner patch is formed on the photoconductive drum 200. All pixels (picture elements) inside the patch (forming the patch) are exposed with a maximum powered LD writing level, i.e., the level 255. The latent image of the toner patch is then developed with black toner contained in the black developing device 231K. The toner patch is formed in an image forming area of the photoconductive drum 200 such that the toner patch image is transferred onto a transfer paper P. The transfer paper P carrying the toner patch is placed on the platen glass 121 of the color scanner 1 such that the toner patch is read by the color scanner 1.

Step S3 is a process of measuring the amount of toner adhered to the toner patch. In step S3, the amount of toner adhered to the toner patch is measured by the toner-amount sensor 205, and output data is sent and stored in the RAM of the control unit 400 as "Vsp_hosei(Bk)". The control unit 400 converts the data "Vsp_hosei(Bk)" into the amount of adhered toner per unit area using the conversion table shown in FIG. 13, and then stores the converted data for the amount of adhered toner in the RAM of the control unit 400 as "MA_psen(Bk)". After the measurement, the toner patch is transferred to the intermediate transfer belt 501.

Step S4 is a test and branch process that tests if the steps S2 and S3 for each of the four colors, i.e. K, C, M, and Y, have been performed. If the steps S2 and S3 are not performed for all colors, then the process returns to step S2. If the steps S2 and S3 are performed for all colors, the process proceeds to step S5.

These three processes in steps S2, S3, and S4 are repeated four times in order of black, cyan, magenta, and yellow toner. Data for each of the other colors, Vsp_hosei(C), MA_psen(C), Vsp_hosei(M), MA_psen(M), and Vsp_hosei(Y), MA_psen(Y), is obtained in substantially the same way as described above and is stored in the RAM of the control unit 400 in these steps. In step S2, the color toner patch for each color is formed on the photoconductive drum 200 to be transferred onto the intermediate transfer belt 501 at different places from each other, such that the toner patch for each color is subsequently transferred onto the transfer paper P as illustrated in FIG. 15.

In step S5, the toner patches on the intermediate transfer belt 501 are transferred at one time to the transfer paper P. Then, each of the toner patches on the transfer paper P is fused and fixed, and the paper P is then ejected out of the photocopier.

Figures 15, 16:
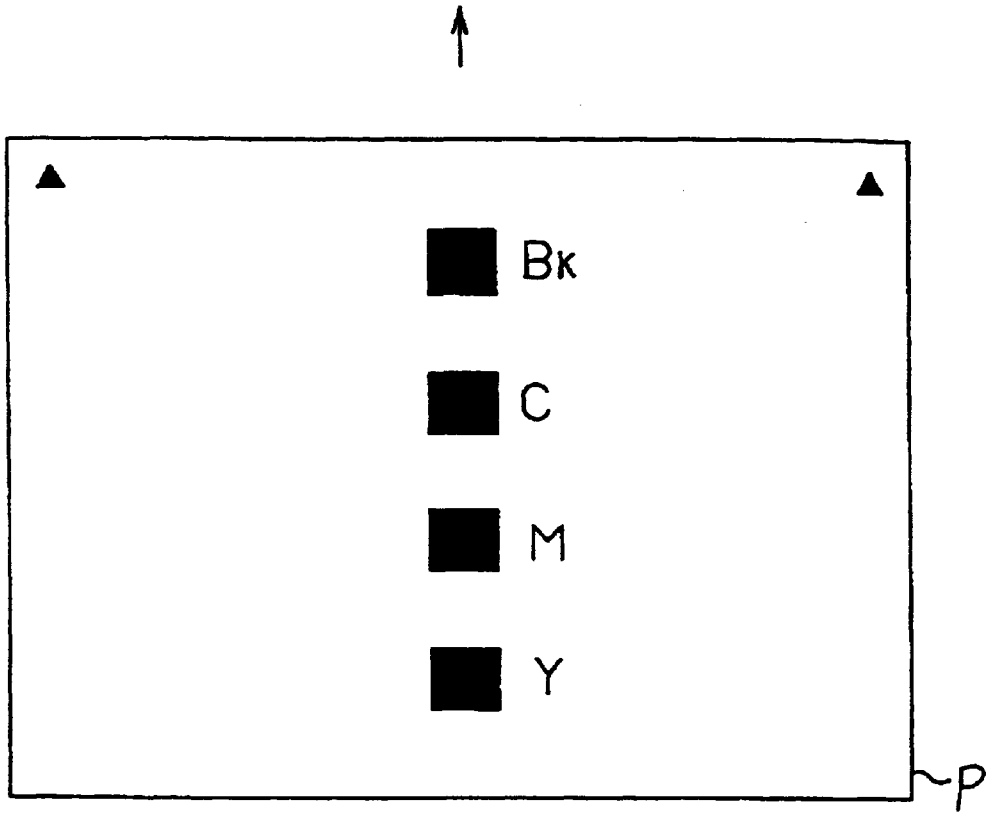
FIG. 15 is an illustration showing an exemplary output of a plurality of toner patch images on a transfer paper.
FIG. 16 is a diagram showing an exemplary conversion table in which values for an amount of adhered toner are converted from values in the table shown in FIG. 13(*b*) according to the operation shown in FIG. 14.

In addition, when the latent image of the toner patch is formed for the black color, an additional latent image of two triangle marks is formed at the same time, and a toner image of these triangle marks is transferred onto the transfer paper P as illustrated in FIG. 15. These triangle marks are formed to indicate the direction to place the paper P on the platen glass.

In step S6, the transfer paper P carrying the toner patches is placed on the platen glass of the color scanner 1 such that the triangle marks register with a reading start position of the color scanner 1. Reading of the toner patches on the transfer paper P starts in response to a "reading start" key input by the operator via the operation panel 420.

In step S7, the image-processing unit 300 converts the data obtained by the color scanner 1 into image density data and sends the image density data to the control unit 400. As described above, the toner patches are formed by exposing all of the pixels forming the toner patches with maximum powered LD writing, which is referred to as level 255 of LD writing. Therefore, the image of the toner patches has a high density such that the surface characteristics of the transfer paper P hardly affect the reading of the toner patch image carried thereupon. Thus, by exposing all pixels of the toner patches with maximum powered LD writing, and developing the toner patches with high density, precise reading of the density of the toner patches is enabled without considering any compensation for the optical characteristics of the transfer paper P.

If one or plural half-tone toner patches are formed instead of the toner patches in which all of the pixels are formed with maximum powered LD writing as described above, it is desirable that the effect of the optical characteristics of the transfer paper P is compensated for by measuring the density of the paper P itself.

In step S8, the control unit 400 converts the image density data into the amount of toner adhered on the paper P per unit area for each color using a conversion table (not shown) in the ROM or RAM of the control unit 400. The conversion table includes plural pairs of image density vs. amount of toner adhered on the paper P per unit area in mg/cm$^2$. The above conversion of the image density data into the amount of toner adhered to a toner image can also be accomplished by using an approximation, such as a polynomial, instead of the conversion table. The converted data, that is, the amount of toner transferred onto the transfer paper P per unit area in mg/cm$^2$, is hereinafter referred to as "MA_scan".

In step S9, the conversion tables shown in FIGS. 13(*a*), 13(*b*), which are used when the control unit 400 converts the outputs of the toner-amount sensor 205 into the amount of toner adhered to a toner image on the photoconductive drum 200, are corrected by utilizing the "MA_scan" value as follows.

When the sensor 205 is not stained by toner and the photoconductive drum 200 does not have any scratch thereupon, then the following equation holds:

$$MA_scan = MA_psen \times Ct$$

where Ct=transfer efficiency=toner weight on the transfer paper P/toner weight on the photoconductive drum 200. "Ct" is set to 0.95 (95 percent) in the embodiment. Therefore, when the above equation does not hold, a compensation is applied, and, as a coefficient, MA_scan/(MA_psen×Ct) is multiplied for each amount of toner adhered to a toner image (mg/cm$^2$) of the conversion table shown in FIG. 13.

Typically, a toner image is not perfectly transferred to a transfer paper P, that is, some toner remains on the photoconductive drum 200 or the intermediate transfer belt 501 such that the transfer efficiency remains below 1.0.

When the toner-amount sensor 205 outputs, for example, 1.8 as "Vsp_hosei" for a cyan toner patch, the value 1.8 is converted into 1.0 mg/cm$^2$ as "MA_psen" according to the table shown in FIG. 13(2*b*).

Then, the toner patch is transferred to a transfer paper P, and the color scanner 1 reads the transferred toner patch, as described in the above step S6. The read data is converted into image density data as described in step S7, and then the image density data is converted into the amount of toner adhered on the paper P per unit area as described in step S8.

Assume that the output amount for toner adhered per unit area of the paper P in step S8 is, for example, 0.900 mg/cm$^2$. Then, the amount of adhered toner per unit area of the photoconductive drum 200 is 0.900/0.95 (=0.947). Accordingly, the amount of toner adhered to a toner image per unit area of the photoconductive drum 200 is determined as 0.947 mg/cm$^2$. The number 0.947 is used as a coefficient for correcting the conversion table for the cyan toner shown in FIG. 13(*b*), such that, for example, the amount of adhered toner is 0.379 (=0.4×0.947) when (Vsp−Vsg) is 0.900, 0.947(=1.0−0.947) when (Vsp−Vsg) is 1.800, and so on. FIG. 16 shows a conversion table corrected in this manner.

A coefficient for altering the conversion table for color toner shown in FIG. 13(*b*) can be obtained as a mean value of cyan, magenta, and yellow data instead of obtaining only one data as described above.

The conversion table for color toner, which is shown in FIG. 13(*b*), is commonly used for cyan, magenta, and yellow in this embodiment. However, the conversion table can be independent for each toner, in which case, each table is corrected according to data for each color.

The conversion table for black toner shown in FIG. 13(*a*) is corrected in a similar manner.

After these corrections, the control unit 400 converts the output of the toner-amount sensor 205 into an amount of toner adhered to a toner image using the corrected conversion tables. The control unit 400 then controls the toner supply operation according to the corrected amount of toner adhered to a toner image, such that an optimum image quality is obtained.

Figure 17:
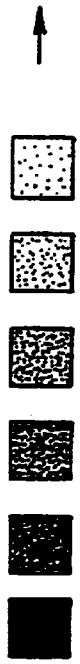
FIG. 17 is an illustration showing an exemplary output of toner patch images for a color with a plurality of image gradations.

In this embodiment, a single correcting coefficient is used for all pairs of (Vsp−Vsg) value vs. adhered-toner amount value. However, a plurality of different coefficients can be used according to each pair of (Vsp−Vsg) value. Further, as shown in FIG. 17, multiple toner patches, each of which is different in gradation with each other, can be formed in a rotating direction of the photoconductive drum 200 to obtain a plurality of different coefficients for each half-toned gradation. The reason why the multiple toner patches different in gradation with each other are formed in a row along the rotating direction of the photoconductive drum 200 as described above is to simplify the configuration of the toner patch measuring mechanism. That is, the toner-amount sensor 205 is not required to be moved for measuring the toner patches for different gradations and the color scanner 1 can read all over a width of a sheet on which toner patches are printed.

Furthermore, when the number of toner patches is smaller than the number of pairs of (Vsp−Vsg) value vs. amount of adhered toner value in the conversion table, correcting coefficients for the amount of adhered toner value can be obtained by interpolation.

Figure 18:
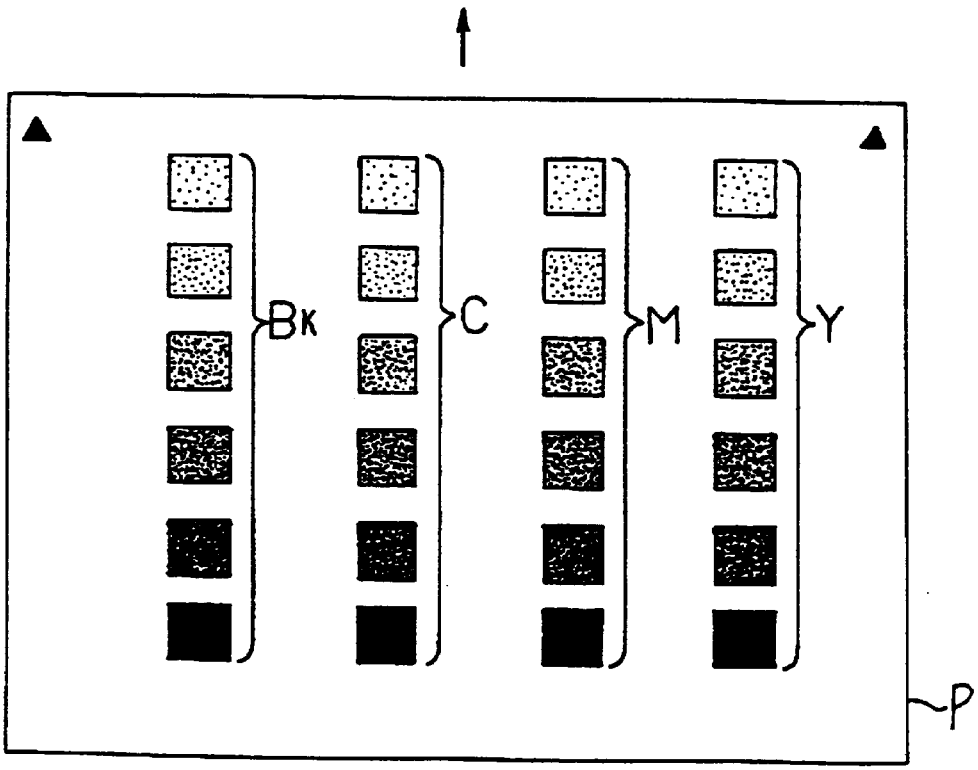
FIG. 18 is an illustration showing exemplary output toner patch images for a plurality of colors, each with a plurality of image gradations.

It is possible to form color patches independently for measurement for the toner-amount sensor 205 and for color scanner 1. For instance, color patches for the toner-amount sensor 205 for multiple toner patches different in gradation with each other can be formed in a row sequentially for each color so as to cause each color patch to be aligned on a transfer paper P. FIG. 18 shows an example of such an output. Consequently, it contributes to not only saving transfer papers, but also saving the operation time for reading the output paper by color scanner 1. In addition, some toners are affected by being lighted by ultrared, such as affecting transfer rate change caused by discharging of the photoconductive drum 200 under the toners. However, by this method, since toner patches formed for outputting on a paper are formed and transferred to the intermediate transfer belt 501 without infrared light beating, a transfer rate is not affected and is stable.

Furthermore, although toner patches are formed on the photoconductive drum 200 in the embodiment described above, the toner patches may be formed on another image carrier, such as the intermediate transfer belt 501, to be measured in a similar manner as on the photoconductive drum 200.

As described above, an image forming apparatus of the present invention is capable of precisely measuring the amount of toner adhered to a toner image on an image carrier for performing a precise image quality control even when a toner-amount measuring device is stained, for example by toner, or a surface of the image carrier is damaged.

Further, in the image forming apparatus of the present invention, as described above, the toner-amount measuring device measures irregular reflection light from a toner image on the image carrier. Therefore, the image forming apparatus can measure a relatively large amount, such as, for example, $lmg/cm^2$ of toner adhered to a toner image on the image carrier.

Further, in the image forming apparatus of the present invention, as described above, the control device has a function to control image quality, such as gradation, and/or toner concentration of the developer-mix, utilizing the corrected output of the toner-amount sensor. Therefore, the image forming apparatus is capable of forming high quality images in a stable manner.

Further, in the image forming apparatus of the present invention, as described above, the image of the toner patch can have a high density such that the surface characteristics of the transfer paper P hardly affect reading of the toner patch when the image of the toner patch is read by the scanner for correcting a table to convert the output of the toner-amount measuring device into an amount of toner.

Further, the image of the internally generated image pattern which is carried by a transfer paper P and which is read by the image reading device is the toner image which is formed on the image carrying member and the density of which is measured by the toner-amount measuring device for correcting the table to convert the output of the toner-amount measuring device into an amount of toner. Since the density of toner of a toner image on the transfer paper P has a close relation to the amount of toner adhered to the toner image when the toner image is formed on the image carrier, the image forming apparatus can correct the table to convert the output of the toner-amount sensor into an amount of toner in a precise manner.

Further, in the image forming apparatus of the present invention, as described above, the output image is different from the one that was previously measured by the toner-amount measuring device, and includes a plurality of colors. Therefore, the image forming apparatus enables saving transfer papers and correction time for correcting the table to convert the output of the toner-amount sensor into an amount of toner.

Obviously, numerous additional modifications and variations of the present invention are possible in light of the above teachings. In particular, features described for certain embodiments may be employed in a logical manner to other embodiments described herein. It is therefore to be understood that within the scope of the appended claims, the present invention may be practiced otherwise than as specifically described herein.

This document is based on japanese patent application no. 10-023361 filed in the japanese patent office on feb. 4, 1998, and the entire contents of which are hereby incorporated by reference.

What is claimed is:

1. An image forming apparatus, comprising:

image carrying means for forming and carrying a toner image thereupon;

image reading means for optically reading an image to obtain image data of the image for output;

image processing means for converting the image data, which is output by the image reading means, into printing image data;

image writing means for writing a latent image on the image carrying means according to the printing image data;

developing means for developing the latent image on the image carrying means with toner to form a toner image;

image outputting means for transferring the toner image, which is developed by the developing means on the image carrying means, to a transfer member and outputting the transfer member carrying the toner image;

internal pattern generating means for generating a predetermined image pattern;

toner-amount measuring means for measuring an amount of toner adhered to a toner image of the predetermined image pattern that is formed on the image carrying means; and control means for correcting a conversion table to convert an output of the toner-amount measuring means into an amount of toner according to image density data of the toner image of the predetermined image pattern that is output by the image outputting means, the image density data being converted from image data obtained by reading, with the image reading means, the toner image of the internally generated predetermined image pattern that is output by the image outputting means.

2. The image forming apparatus according to claim 1, wherein the toner-amount measuring means includes an optical sensor that measures irregular reflection light.

3. The image forming apparatus according claim 1, wherein the control means controls an image quality utilizing the corrected conversion table.

4. The image forming apparatus according claim 1, wherein the image writing means includes a laser oscillator and the internally generated image pattern is formed with a substantially same condition as an immediately preceding image forming condition except that the latent image of the internally generated image pattern is written by the laser oscillator with a maximum output power of the laser oscillator.

5. The image forming apparatus according claim 1, wherein the toner image of the predetermined image pattern formed on the image carrying means is transferred onto the transfer member after the amount of toner adhered to the toner image of the predetermined pattern is measured by the toner-amount measuring means, and then the toner image of the predetermined image pattern transferred onto the transfer member is read by the image reading means.

6. The image forming apparatus according claim 1, wherein the image outputting means for transferring the toner image includes an intermediate transfer member for transferring the toner image on the image carrying means thereupon, and the toner image of the predetermined image pattern that is read by the image reading means is formed for each of a plurality of colors on the image carrying means and each of the toner images for each of the plurality of colors is transferred onto the transfer member at one time via the intermediate transfer member.

7. An image forming apparatus, comprising:

an image carrier configured to form and carry a toner image thereupon;

an image reader configured to optically read an image to obtain image data of the image for output;

an image processor configured to convert the image data, which is output by the image reader, into printing image data;

an image writer configured to write a latent image on the image carrier according to the printing image data;

a developer configured to develop the latent image on the image carrier with toner to form a toner image;

an image output configured to transfer the toner image, which is developed by the developer on the image carrier, to a transfer member and to output the transfer member carrying the toner image;

an internal pattern generator configured to generate a predetermined image pattern;

a toner sensor configured to sense an amount of toner adhered to a toner image of the predetermined image pattern that is formed on the image carrier; and a controller configured to correct a conversion table to convert an output of the toner sensor into an amount of toner according to image density data of the toner image of the predetermined image pattern that is output by the image output, the image density data being converted from image data obtained by reading, with the image reader, the toner image of the internally generated predetermined image pattern that is output by the image output.

8. The image forming apparatus according to claim 7, wherein the toner sensor includes an optical sensor that measures irregular reflection light.

9. The image forming apparatus according claim 7, wherein the controller controls an image quality utilizing the corrected conversion table.

10. The image forming apparatus according claim 7, wherein the image writer includes a laser oscillator and the internally generated image pattern is formed with a substantially same condition as an immediately preceding image forming condition except that the latent image of the internally generated image pattern is written by the laser oscillator with a maximum output power of the laser oscillator.

11. The image forming apparatus according claim 7, wherein the toner image of the predetermined image pattern formed on the image carrier is transferred onto the transfer member after the amount of toner adhered to the toner image of the predetermined pattern is measured by the toner sensor, and then the toner image of the predetermined image pattern transferred onto the transfer member is read by the image reader.

12. The image forming apparatus according claim 7, wherein the image output includes an intermediate transfer member configured to transfer the toner image on the image carrier thereupon, and the toner image of the predetermined image pattern that is read by the image reader is formed for each of a plurality of colors on the image carrier and each of the toner images for each of the plurality of colors is transferred onto the transfer member at one time via the intermediate transfer member.

13. A method for detecting an amount of toner adhered to a toner image on an image carrier of an image forming apparatus, comprising steps of:

generating an image signal for a predetermined patch;

forming a latent image of the patch on the image carrier according to the generated image signal by an image writing device;

developing the latent patch image with toner into a toner patch image;

measuring the toner patch image on the image carrier by a toner-amount measuring device;

transferring the toner patch image to a transfer member;

outputting the transfer member carrying the toner patch image thereon;

reading the toner patch image on the transfer member to obtain data of the toner patch image by an image reading device;

converting the data of the toner patch image on the transfer member into image density related data; and correcting a table to convert an output of a toner-amount measuring device into an amount of toner according to the image density related data.

* * * * *